US005259465A

United States Patent [19]

Mukoyama

[11] Patent Number: 5,259,465

[45] Date of Patent: Nov. 9, 1993

[54] FILTER FOR A PNEUMATIC TOOL

[75] Inventor: Kenzi Mukoyama, Anjo, Japan

[73] Assignee: Makita Electric Works, Ltd., Anjo, Japan

[21] Appl. No.: 908,566

[22] Filed: Jun. 30, 1992

Related U.S. Application Data

[63] Continuation of Ser. No. 639,147, Jan. 8, 1991, abandoned.

[30] Foreign Application Priority Data

Jan. 10, 1990 [JP] Japan ..... 2-3847

[51] Int. Cl.[5] ..... B25C 5/13

[52] U.S. Cl. ..... 173/168; 227/130

[58] Field of Search ..... 227/130, 147; 173/168, 173/169; 81/57.44

[56] References Cited

U.S. PATENT DOCUMENTS

| | | | |
|---|---|---|---|
| 2,784,818 | 3/1957 | Mauer | 173/169 X |
| 2,898,791 | 8/1959 | Mauer | 173/169 X |
| 2,939,675 | 6/1960 | Karden | 173/169 X |
| 4,776,561 | 10/1988 | Braunlich et al. | 173/169 X |

FOREIGN PATENT DOCUMENTS

| | | | |
|---|---|---|---|
| 120233 | 8/1965 | Netherlands | 173/169 |

*Primary Examiner*—Hien H. Phan
*Assistant Examiner*—Clark F. Dexter
*Attorney, Agent, or Firm*—Dennison, Meserole, Pollack & Scheiner

[57] ABSTRACT

A pneumatic tool includes a body, an air chamber formed within a part of the body for storing compressed air and an inlet port formed in the part of said body for entry of the compressed air into the air chamber. A filter is disposed within the air chamber in the vicinity of the inlet port for capturing dust.

6 Claims, 6 Drawing Sheets

FILTER FOR A PNEUMATIC TOOL

This is a continuation of copending application(s) Ser. No. 07/639,147 filed on Jan. 8, 1991, abandoned.

BACKGROUND OF THE INVENTION

1. Field of the Invention

This invention relates to a pneumatic tool such as a nailing machine having an air chamber for storing compressed air.

2. Description of the Prior Art

In general, a pneumatic tool includes an air chamber for storing compressed air which is used as a power source. The air chamber is detachably connected with a hose from a compressed air source through a joint which is mounted to an inlet port of the air chamber. The hose is frequently connected with or disconnected from the joint for exchange of the tool. Such frequent connecting and disconnecting operations may possibly cause entry of dust into the air chamber through the joint. The dust may further enter a trigger valve, a head valve, a percussion cylinder, etc. in the tool and particularly cause deterioration of seal members such as O-rings or cause flaws on the sealing surface of them, thereby causing insufficient sealing.

To prevent entry of dust, it has been proposed to provide a filter in the joint for capturing the dust.

The joint, however, has small flow area and the filter must have small size. Therefore, the filter may prevent flow of air causing insufficient amount of flow if it has fine mesh. On the other hand, the filter may not capture fine dust if it has coarse mesh.

Japanese Laid-Open Utility Model Publication No. 57-202676 discloses a cap covering a joint for preventing entry of dust when a tool is not used. The cap can be removed from the joint for connection of the joint with a compressed air source.

However, the cap requires cumbersome operation for engaging and disengaging the same. Further, it cannot prevent entry of the dust which exists in the hose for connection with the joint or the dust including the rust produced in the compressed air source such as an air compressor.

SUMMARY OF THE INVENTION

It is, accordingly, an object of the present invention to provide a pneumatic tool which permits use of a filter with fine mesh for capturing fine dust while ensuring sufficient flow of air.

It is another object of the present invention to provide a pneumatic tool which can prevent entry of dust from a hose for connection with a joint or dust from the air source.

According to the present invention, there is provided a pneumatic tool comprising:

a body;

an air chamber formed within a part of the body for storing air from a compressed air source;

an inlet port formed in the part of the body for entry of the air from the compressed air source to the air chamber; and a filter disposed within the air chamber in the vicinity of the inlet port for capturing dust.

The part of the body may be separated into a first portion including the inlet port and a second portion. The first portion is detachable from the second portion.

The filter is held between the first portion and the second portion.

The part of the body is a handle integrally formed with the body for an operator to grasp.

The invention will become more fully apparent from the claims and the description as it proceeds in connection with drawings.

DETAILED DESCRIPTION OF THE PREFERRED EMBODIMENT

Figure 1:
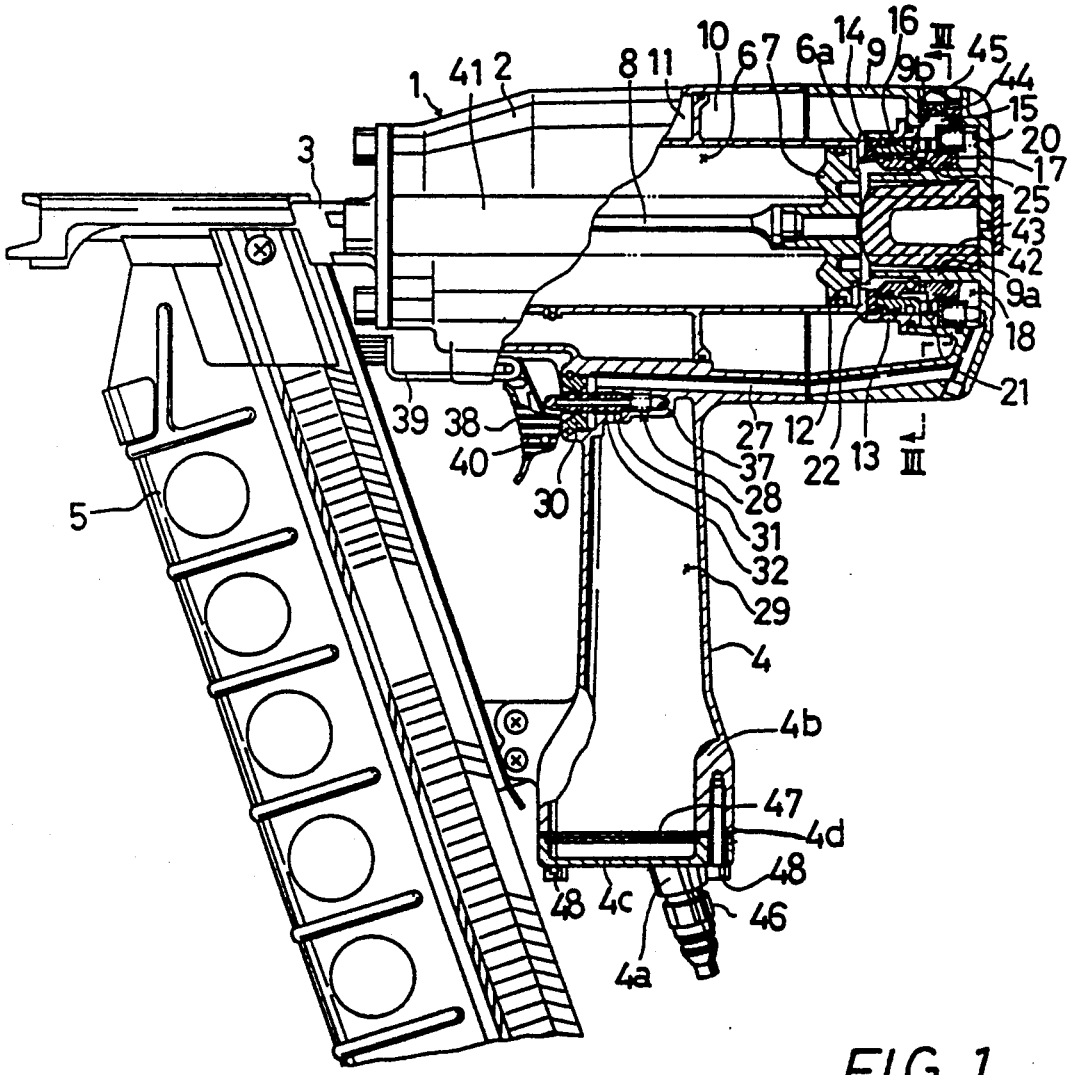
FIG. 1 is a front view of a nailing machine according to an embodiment of the present invention with a part of the body and the handle broken away.

Referring to FIG. 1, there is shown a pneumatic nailing machine according to an embodiment of the present invention.

In general, the nailing machine includes a body 1 forming a body housing 2 which accommodates a drive mechanism as will be hereinafter explained. The nailing machine further includes a driver guide 3 mounted on one end of the body housing 2, a handle 4 integrally formed with the body housing 2 and extending radially outwardly from the central portion of the body housing 2 in a longitudinal direction thereof, and a magazine 5 (partly shown in FIG. 1) accomodating a plurality of nails and extending obliquely to the body hausing 2. The magazine 5 is joined at one end thereof to one end of the driver guide 3 and at the middle portion thereof to the handle 4.

A cylinder 6 is formed within the body housing 2 and extends in a longitudinal direction of the body housing 2. A percussion piston 7 is disposed within the cylinder 6 and is slidably movable in the longitudinal direction. A driver 8 extends through the percussion piston 7 on its central axis into the driver guide 3 and is fixed to the percussion piston 7. A head housing 9 is mounted on the other end of the body housing 2. A main air chamber 10 and a return air chamber 11 are formed within the body housing 2. The main air chamber 10 and the return air chamber 11 are disposed outwardly of the cylinder 6 and are separated from each other. The main air chamber 10 extends from substantially the central portion of the body housing 2 to the head housing 9 while the return air chamber 11 extends from substantially the central portion of the body housing 2 to the end of the body housing 2 opposite to the head housing 9.

The cylinder 6 is formed with a partition wall **6*a*, while the head housing 9 is formed with an inner partition wall 9*a* and an outer partition wall 9*b* which are coaxially disposed. A percussion piston chamber 12 is formed on the side of the head housing 9 and is separated from the main air chamber 10 by the partition wall 6*a* and the inner partition wall 9*a*. The percussion piston chamber 12 is communicated with the main air chamber 10 through a plurality of first communication holes 13** which are formed on the partition wall 6a and are disposed in a circumferential direction of the partition wall 6a at the middle portion thereof. An annular portion 6a1 is formed with the partition wall 6a for defining an end of stroke of the percussion piston 7, and the percussion piston chamber 12 is communicated with the interior of the cylinder 6 through the annular portion 6a1. A valve seat 14 is mounted on the annular portion 6a1 on the side of the percussion piston chamber 12. The percussion piston chamber 12 is communicated with the outside of the body 1 through an outlet port 15 which is positioned at the middle portion of the percussion piston chamber 12 and extends in a radial direction thereof. A first head valve 16 and a second head valve 17 are disposed in the percussion piston chamber 12 and are slidably movable in a longitudinal direction thereof. The first head valve 16 is cylindrical and includes a first portion 16a of small diameter and a second portion 16b of large diameter. The outer surface of the first portion 16a is slidably in contact with the inner surface of the partition wall 6a, and one end of the first portion 16a is opposed to the valve seat 14. The outer surface of the second portion 16b is slidably in contact with the inner surface of the outer partition wall 9b of the head housing 9. One end of the second portion 16b extends into a valve chamber 18 formed between the inner partition wall 9a and the outer partition wall 9b on the side opposite to the valve seat 14. The one end of the second portion 16b is opposed to the inner wall of the valve chamber 18 extending substantially perpendicular to the longitudinal direction. Four recesses 19 are formed on the end surface of the second portion 16b and are equally separated from each other in a circumferential direction. Each of the recesses 19 receives one end of a compression spring 20, the other end of which abuts on the inner wall of the valve chamber 18. Thus the first head valve 16 is urged in a direction toward the valve seat 14 so that the one end of the first portion 16a normally abuts on the valve seat 14. A plurality of first channels 21 are formed at the other end of the first portion 16a of the first head valve 16 next to the second portion 16b for communication between the interior of the percussion piston chamber 12 and the outlet port 15. The first channels 21 are arranged in two rows in a circumferential direction of the first portion 16a. The one end of the first portion 16a includes a surface 22 which may receive pressure of compressed air supplied from the main air chamber 10. A seal member 23a such as an O-ring is provided between the first head valve 16 and the partition wall 6a in the vicinity of the surface 22 for keeping air tight. The head valve 16 includes on the inner surface thereof a stepped portion 16c in the vicinity of the first outlet channels 21 so that the inner surface has a large diameter in a range between the stepped portion 16c and the one end of the second portion 16b. A seal member 23b such as an O-ring is provided between the partition wall 6b and the second portion 16b of the head valve 16 for keeping air tight.

The second head valve 17 is cylindrical and is inserted within the first head valve 16. The second head valve 17 includes on the outer surface thereof a stepped portion 17a at the middle portion in a longitudinal direction. Thus, the second head valve 17 includes a first portion 17b of small outer diameter and a second portion 17c of large outer diameter. The stepped portion 17a of the second head valve 17 is opposed to the stepped portion 16c of the first head valve 16. The outer surface of the first portion 17b is in slidably contact with the inner surface of the first portion 16a of the first head valve 16. The inner partition wall 9a includes a first portion 9a1 of small outer diameter and a second portion 9a2 of large diameter so as to form a stepped portion therebetween. The inner surface of the first portion 17b of the second head valve 17 is opposed to the first portion 9a1 of the inner partition wall 9 and is spaced therefrom at a predetermined distance. The end of the first portion 17b is opposed to the valve seat 14. The outer surface of the second portion 17c is slidably in contact with the inner surface of the second portion 16b of the first head valve 16. The inner surface of the second portion 17c is slidably in contact with the second portion 9a2 of the inner partition wall 9a. The end of the second portion 17c extends into the valve chamber 18 and is opposed to the inner surface of the chamber 18.

A recess 24 is formed on the outer surface of the first portion 17b of the second head valve 17 and extends in a longitudinal direction from the stepped portion 17a at a suitable distance. A plurality of second channels 25 are formed in the first portion 17b in a radial direction and are spaced from each other in a circumferential direction. The second channels 25 are connected with the recess 24 for connection of the percussion piston chamber 12 with the first channels 21 as will be hereinafter described. One end of the first portion 17b is formed to have smaller outer diameter and has a slant surface 17b1 which is exposed to the percussion piston chamber 12.

One end of the second portion 17c of the second valve 17 is formed to have smaller outer diameter so as to form a third channel 25a between the inner surface of the second portion 16b of the first valve 16 for connection between the first channels 21 with the valve chamber 18.

Seal members 26a, 26b such as O-rings are mounted on the outer surfaces of the first portion 17b and the second portion 17c of the second valve 17, respectively, for keeping air tight between the corresponding inner surfaces of the first valve 16. Further, seal members 26c, 26d such as O-rings are mounted on the inner surfaces of the first portion 17b and the second portion 17c, respectively, for keeping air tight between the second portion 9a2 of the inner partition wall 9a.

When the first and second head valves 16 and 17 are in a position to contact the valve seat 14, the first row or one of the rows of the first channels 21 and the second channels 25 are communicated with each other and are opened to the outlet port 15 and the percussion piston chamber 12, respectively. Further, in this position, the first and second head valves 16, 17 prevent communication between the main air chamber 10 and the percussion piston chamber 12 and between the valve chamber 18 and the outlet port 15 through the third channel 25a and the second row or another row of the first channels 21. When the first head valve 16 is moved away from the valve seat 14, the second row of the first channels 21 is firstly communicated with the valve chamber 18 through the third channel 25a. The first head valve 16 thereafter moves the second head valve 17 through the engagement of the stepped portion 16c with the stepped portion 17a so as to permit communication between the main air chamber 10 and the percussion piston chamber 12 and to prevent communication between the first row of the first channels 21 and the second channels 25.

A fourth channel 27 is formed through the body housing 2 and the head housing 9. One end of the fourth channel 27 is connected with the valve chamber 18. The other end of the fourth channel 27 is connected with a trigger valve 32 which can be operated to selectively communicate the fourth channel 27 with a trigger valve chamber 28 or with the outside as will be hereinafter described.

Figure 5:
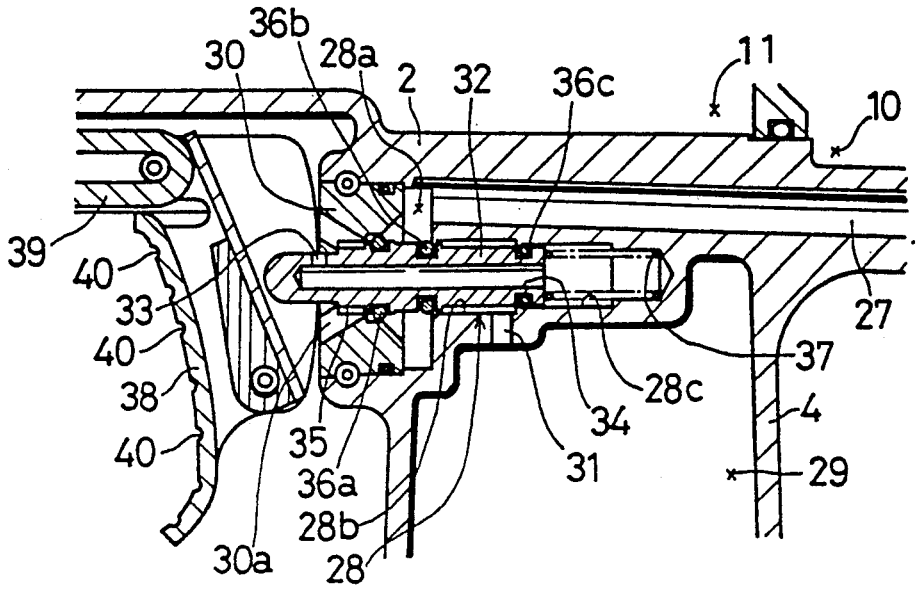
FIG. 5 is an enlarged vertical sectional view of the trigger and the trigger valve shown in FIG. 1.

As shown in FIG. 5, the trigger valve chamber 28 is formed in the uppermost portion of the handle 4. The handle 4 includes therein a second air chamber 29 which is separated from the trigger valve chamber 28. The trigger valve chamber 28 includes in series a first hole 28*a* opened at one end to the outside, a second hole 28*b* and a third hole 28*c* closed at one end, the diameter of which are in turn gradually reduced. The first hole 28*a* is opened to the fourth channel 27 at the other end. A seal member 30 is inserted into the first hole 28 so as to seal the same from the outside. The second hole 28*b* is connected with the second air chamber 29 through a communication hole 31. The trigger valve 32 is slidably inserted within the trigger valve chamber 28 through the seal member 30. The trigger valve 32 includes a middle portion of large diameter which is permitted to move between the first hole 28 and the second hole 28 through the seal member 30. One end of the trigger valve 32 having relatively small diameter extends into the third hole 28*c* while the other end thereof also having relatively small diameter is permitted to move in and out of the seal member 30. The trigger valve 32 includes therein a channel 34 which extends in a longitudinal direction and is opened at one end into the third hole 28*c*. A slot 33 is formed at the other end of the trigger valve 32 for communication of the channel 34 with the outside. A space 35 is formed between the trigger valve 32 and the seal member 30 for communication of the first hole 28*a* with the outside through a channel 30*a* formed in the seal member 30. Such communication of the first hole 28*a* with the outside is normally prevented by a seal member 36*a* such as an O-ring. Seal members 36*b* and 36*c* such as O-rings are provided for sealing between the first hole 28*a* and the second hole 28*b*, and between the second hole 28*b* and the third hole 28*c*, respectively. A spring 37 is disposed within the third hole 28*c* for biasing the trigger valve 32 outwardly, and the trigger valve 32 is normally engaged by the seal member 30. In the state shown in FIG. 5, the communication between the first hole 28*a* and the outside is prevented by the seal member 36*a*, and the seal member 36*b* in a position to permit communication between the first hole 28*a* and the second hole 28*b*. A trigger 38 is disposed outside of the handle 4 and can be pulled by the operator for operation of the trigger valve 32. The trigger 38 is associated with a contact arm 39 which constitutes a safety member at the nailing operation. A plurality of grooves 40 are formed on the trigger 38 for preventing slippage of the fingers of the operator.

Thus, when the trigger 38 is not pulled, the compressed air in the second air chamber 29 enters the fourth channel 27 through the communication hole 31, the second hole 28*b* and the first hole 28*a*. When the trigger 38 is pulled to move the trigger valve 32 against the spring 37, the communication between the first hole 28*a* and the second hole 28*b* is prevented by the seal member 36*b* while the communication between the first hole 28*a* and the outside is permitted through the movement of the position of the seal member 36*a*, so that the fourth channel 27 is opened to the outside.

Figure 2:
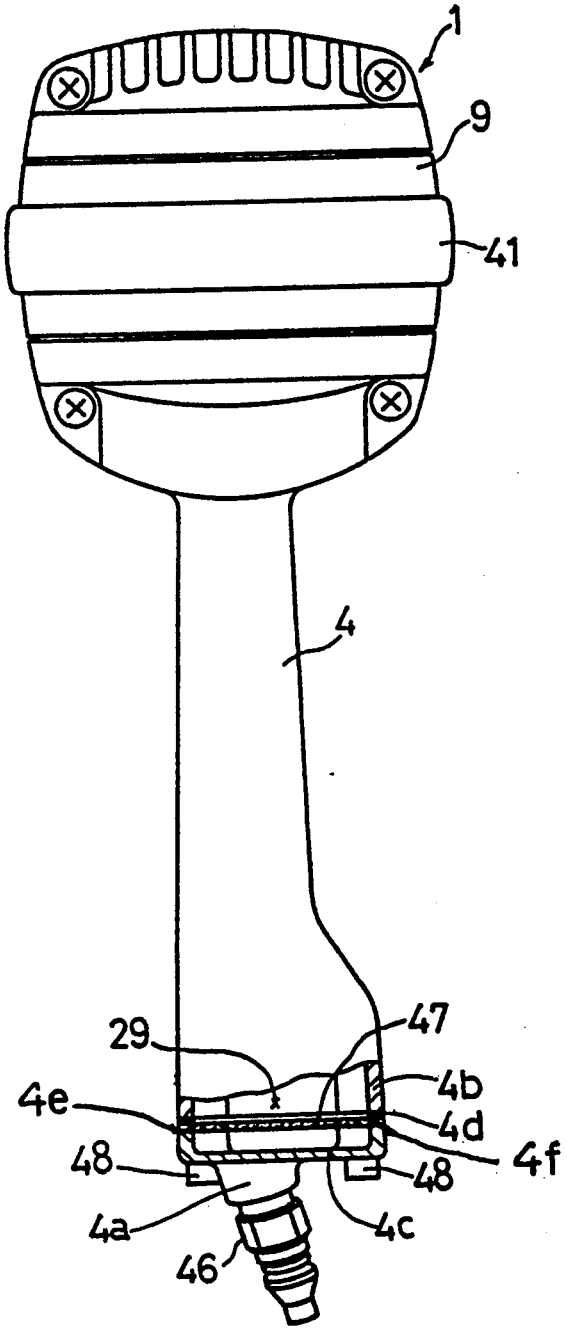
FIG. 2 is a side view of the nailing machine shown in FIG. 1.

As shown in FIGS. 1 and 2, a protective band 41 such as a rubber strip is attached to surround the outer surface of the body housing 2 and the head housing 9 in their longitudinal direction.

A cylindrical cushion member 42 made of rubber etc. is inserted within the inner partition wall 9*a*. The cushion member 42 is opened at one end which abuts on the head housing 9. The other end of the cushion member 42 is closed and adapted to contact the percussion piston 7. A relief hole 43 is formed in the head housing 9 for communication of the interior of the cushion member 42 with the outside.

Figure 3:
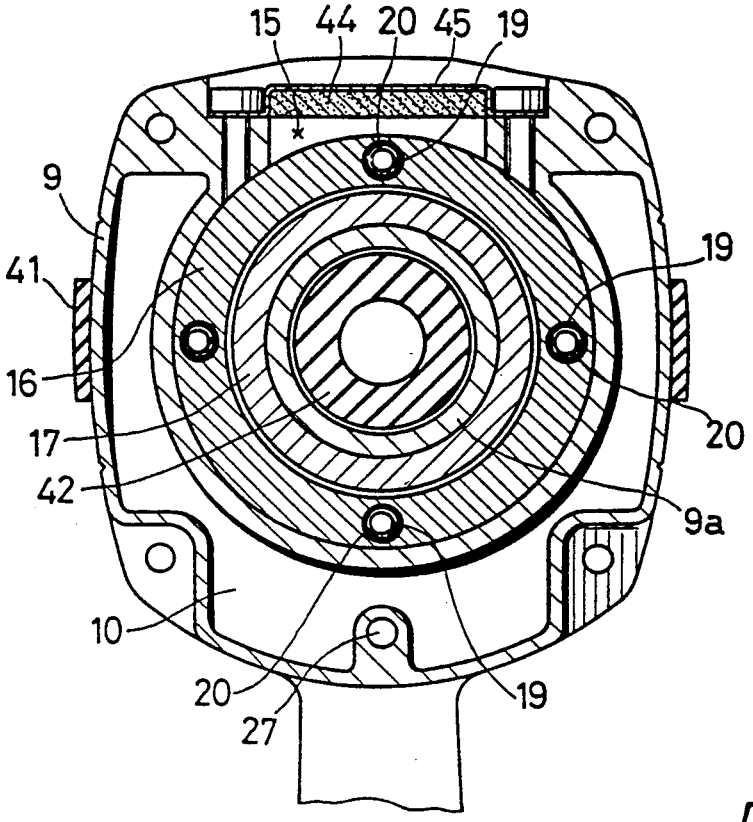
FIG. 3 is an enlarged sectional view of FIG. 1 taken along the line III—III.
Figure 4:
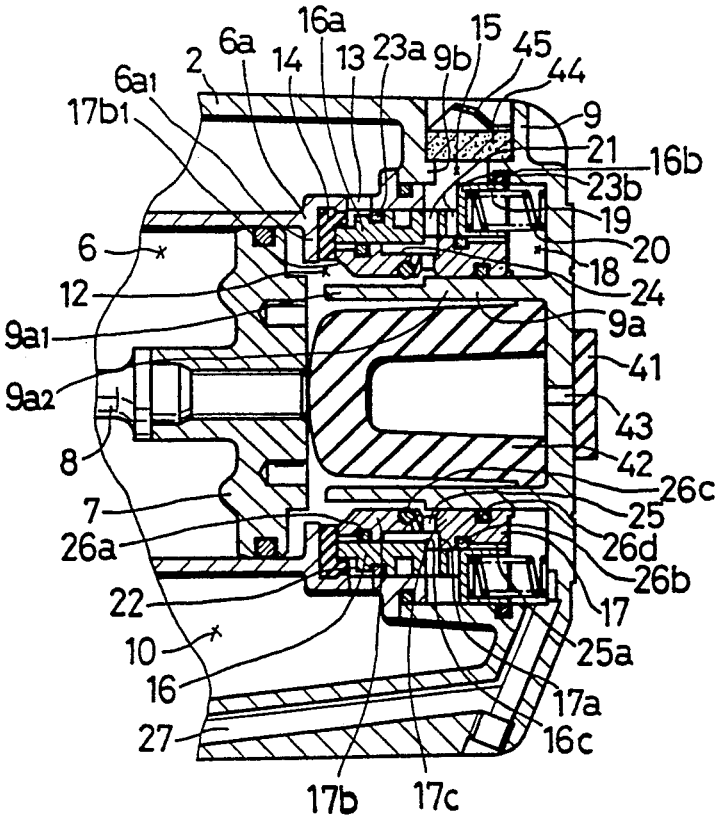
FIG. 4 is an enlarged vertical sectional view of the head valve device shown in FIG. 1.

As shown in FIGS. 3 and 4, a filter 44 is mounted to the outlet port 15 and is covered by a cover member 45.

As shown in FIG. 1, an inlet port 4*a* is formed in the bottom portion 4*c* at the lower end of the handle 4. A joint 46 is connected with the inlet port 4*a* for connection with the compressed air source through a hose (not shown). A mesh-like filter 47 made of synthetic resin etc. is disposed within the second air chamber 29 in the vicinity of the inlet port 4*a*. The handle 4 comprises an open ended handle body 4*b* which has a flat surface 4*d* and a cup-shaped bottom portion 4*c* which includes the inlet port 4*a*. The cup-shaped bottom portion has a circumferential recess 4*e* on an inner surface and flat surface 4*f* is opposed to the flat surface 4*d*. The filter 47 is received in the recess 4*e* so as to be flush with the surface 4*f*.

In operation, when the trigger 38 is not pulled, the repressed air in the second air chamber 29 enters the valve chamber 18 through the trigger valve 32 and the fourth channel 27 and urges the first and second head valves 16 and 17 toward the valve seat 14 as shown in FIG. 4., so that the main air chamber 10 and the percussion piston chamber 12 are prevented from communication therebetween.

In this stage, the biasing force of the spring 20 is applied to the first head valve 16 in addition to the air pressure. The communication between the second row of the first channels 21 and the third channel 25*a* is prevented by the seal member 26*a* between the first head valve 16 and the second head valve 17, so that the communication between the valve chamber 18 and the outlet port 15 is prevented.

When the trigger 38 is pulled so as to move the trigger valve 32 against the spring 27, the fourth channel 27 is communicated with the outside through the trigger valve 32, so that the compressed air in the valve chamber 18 is exhausted to the outside through the fourth channel 27 and the trigger valve chamber 28.

Since the air pressure in the main air chamber 10 is applied to the surface 22 of the first head valve 16 through the communication hole 13, the first head valve 16 is moved against the biasing force of the spring 20 rightwardly in FIG. 4. When the first head valve 16 is moved, the communication between the second row of the first channels 21 and the third channel 25*a* through the movement of the position of the seal member 26*b*, and therefore, the compressed air in the valve chamber 18 is rapidly exhausted from the outlet port 15 through the second row of the first channels 21.

Figure 6:
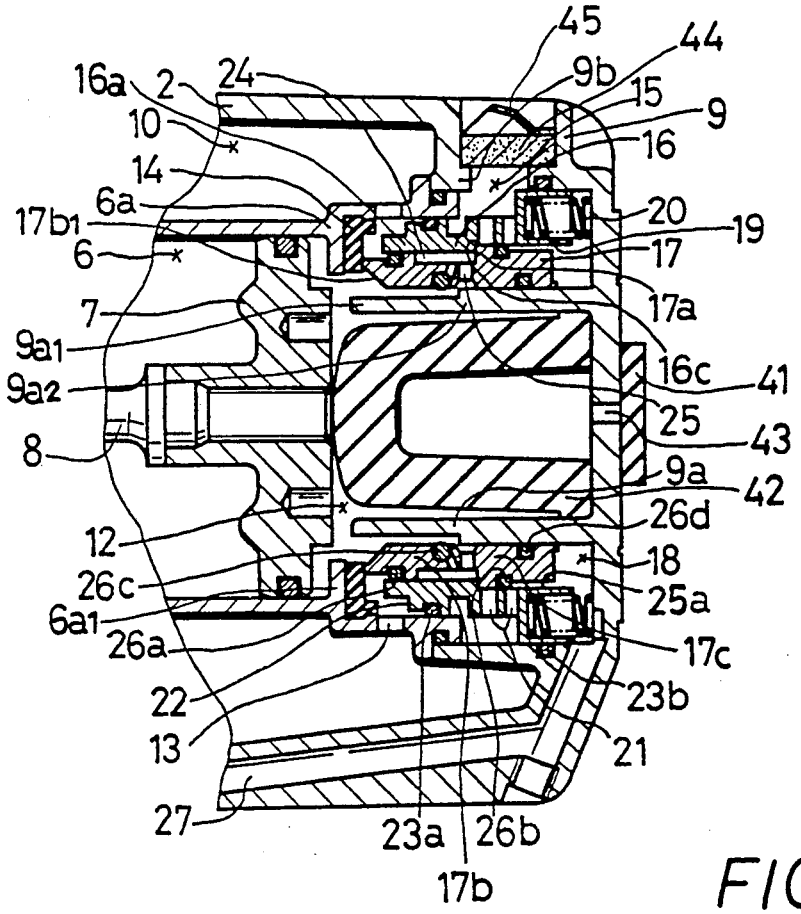
FIGS. 6 to 9 are sectonal views similar to FIG. 4 but showing different operations of the head valve device, respectively.

When the first head valve 16 is further moved rightwardly, the stepped portion 16*c* engages the stepped portion 17*a* of the second head valve 17 so as to move the second head valve 17 therewith as shown in FIG. 6. The first head valve 16 and the second head valve 17 gradually increase the speed of movement by the air pressure applied to their end portions.

When the second head valve 17 is moved rightwardly, the compressed air in the main air chamber 10 flows into the percussion piston chamber 12 from the beginning. Such air flow into the percussion piston chamber 12 does not further flow into the outlet port 15 through the second channel 25 and the first row of the first channels 21 since the engagement of the stepped portion 16c of the first head valve 16 with the stepped portion 17a of the second head valve 17 prevents such leakage of the air into the outlet port 15 in the beginning of the movement of the second head valve 17 through its sealing effect.

Figure 7:
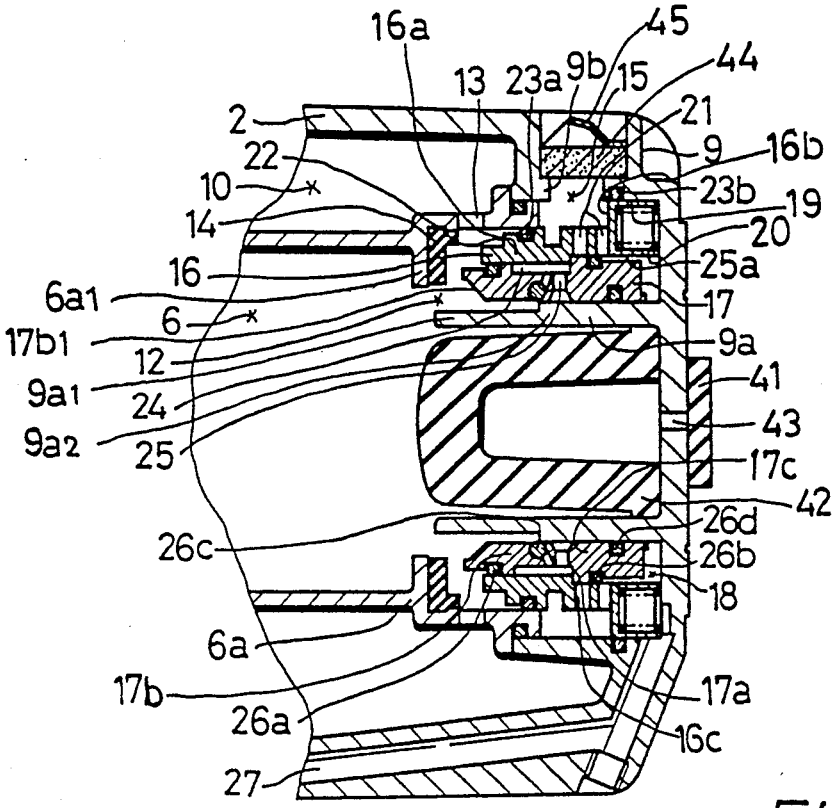

When the second head valve 17 is further moved rightwardly by the first head valve 16 as shown in FIG. 7, the seal member 26c of the second head valve 17 slidably contacts the second portion 9a2 of the inner partition wall 9a so as to prevent communication between the percussion piston chamber 12 and the second channel 25, so that the percussion piston chamber 12 can be completely separated from the outside.

Figure 8:
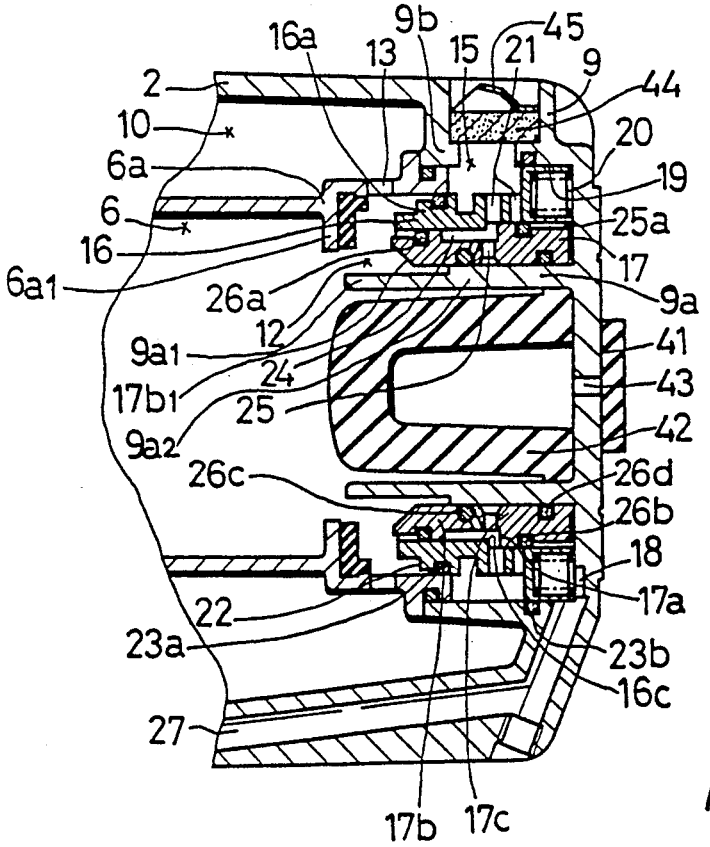

The first head valve 16 terminates its movement by the abutment on the inner wall of the head housing 9 forming the valve chamber 18. The second head valve 17 is thereafter moved further by the pressure of air flown into the percussion piston chamber 12 and terminates its movement by the abutment on the inner wall of the head housing 9 as shown in FIG. 8.

During the movement of the second head valve 17 without assistance of the first head valve 16, the seal member 26c is kept in contact with the second portion 9a2 of the inner partition wall 9, so that the percussion piston chamber 12 is completely separated from the outside. Further, when the second head valve 17 reaches its most rightward position as shown in FIG. 8, the seal member 26b between the first head valve 16 and the second head valve 17 prevents communication between the second row of the first channels 21 and the third channel 25a so that the valve chamber 18 is not communicated with the outlet port 15.

After the first and second head valves 16 and 17 have reached their most rightward position, the compressed air in the main air chamber 10 rapidly enters the percussion piston chamber 12, so that the percussion piston 7 rapidly moves leftwardly for nailing operation.

After the nailing operation, the trigger 38 is released for movement of the trigger valve 32 to return its original position by the force of spring 37, and consequently the communication between the the fourth channel 27 and the outside is prevented while the compressed air in the second air chamber 29 is supplied to the valve chamber 18.

Figure 9:
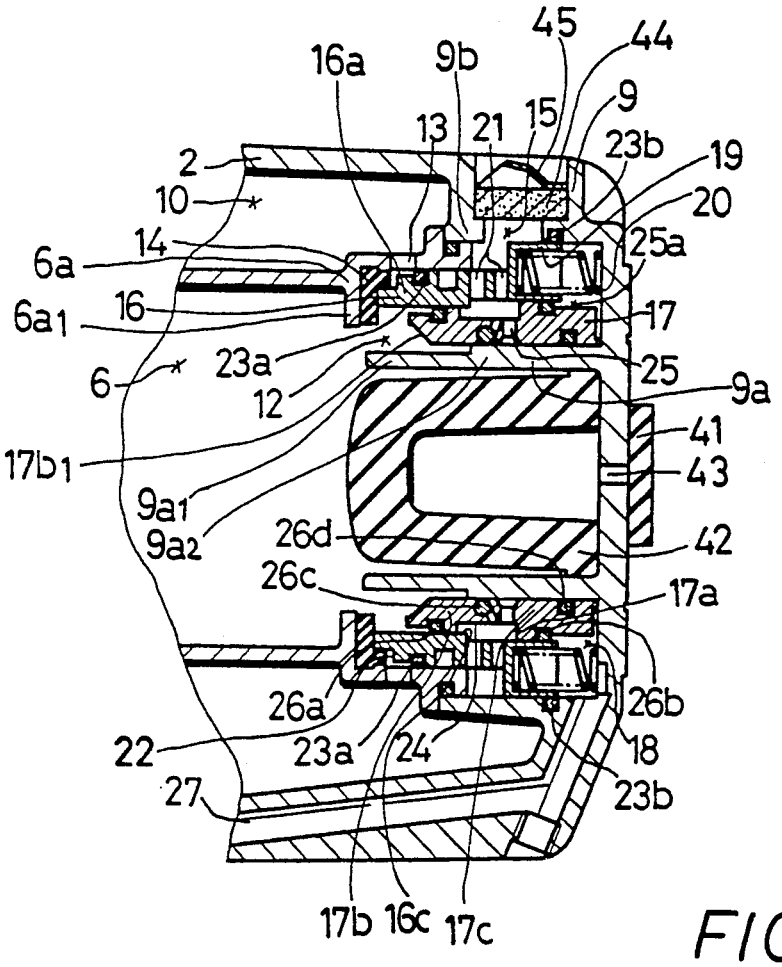

By such supply of the air into the valve chamber 18, the first head valve 16 is firstly moved leftwardly by the pressure of the air and the biasing force of the spring 20. The first head valve 14 is further moved to abut on the valve seat 14 so as to prevent communication between the main air chamber 10 and the percussion piston chamber 12 as shown in FIG. 9.

During such movement of the first head valve 16, the second head valve 17 is kept in position since the first head valve 16 is so constructed that it can move leftwardly in a lower pressure than the pressure which is required for movement of the second head valve 17 in the same direction. Therefore, the seal member 26b between the first head valve 16 and the second head valve 17 is kept to prevent communication between the second row of the first channels 21 and the third channel 25b during this movement, so that the valve chamber 18 and the outlet port 15 is kept to prevent communication therebetween.

The second head valve 16 is subsequently moved leftwardly by the pressure of air flown into the valve chamber 18, and terminates its movement by abutment on the valve seat 14. When the second head valve 16 is moved in a position where the seal member 26c no longer contacts the second portion 9a2 of the inner partition wall 9a, the second channel 25 communicates with the percussion piston chamber 12, so that the percussion piston chamber 12 communicates with the outlet port 15 through the second channel 25, the recess 24 and the first channels 21. Thus, the compressed air in the percussion piston chamber 12 is exhausted to the outside, and therefore, the percussion piston 7 can be moved rapidly rightwardly to return to its original position as shown in FIG. 4. Since the percussion piston chamber 12 is communicated with the outside after the communication between it and the main air chamber 10 has been completely prevented, any leakage of the compressed air from the main air chamber 10 to the outside can be prevented.

One cycle of the nailing operation is thus completed.

In this embodiment, the protective band 41 made of rubber strip etc. surrounds the outer surface of the body housing 2 and the head housing 9 and extends in their longitudinal direction. With such provision of the protective band, the body housing 2 and the head housing 9 are prevented from a shock even if the nailing machine has been thrown down on the floor of the working place after nailing operation. Further, with the provision of the mesh-like filter 47 in the second air chamber 29 of the handle 4, any dust from the joint 46 may not enter the trigger valve chamber 28 or the components of the head valve device. Further, since the filter 47 is held between the handle body 4b and the bottom portion 4c by fastening the bolt 48, the filter 47 can be easily assembled and can be easily removed for exchange or maintainance such as cleaning by removing the bottom portion 4c from the handle body 4b.

While the invention has been described with reference to a preferred embodiment thereof, it is to be understood that modification or variations may be easily made without departing from the scope of the present invention which is defined by the appended claims.

What is claimed is:

1. A pneumatic tool particularly a nailing machine comprising:

a tool body having a cylinder and a piston reciprocally moved by a force of compressed air from an air supply source which is applied to said cylinder to drive a nail;

a hollow handle integrally formed with said tool body, said hollow handle having a longitudinal axis and a cross-sectional area substantially perpendicular to said longitudinal axis, said hollow handle having an open bottom and a peripheral wall wherein said open bottom extends substantially across the entire cross-sectional area of a bottom portion of said hollow handle;

a cup-shaped closure means for closing the open bottom of said hollow handle and shaped complementarily to said hollow handle open bottom, said cup-shaped closure means having a cross-sectional area of substantially the same size as a bottom portion of said hollow handle and including a joint fixed to an inlet port formed on said cup-shaped closure means for connecting said air supply source; and a filter means for filtering said compressed air from said air supply source extending entirely across said hollow handle open bottom and secured between said hollow handle and said cup-shaped closure means; said hollow handle and cup-shaped closure means defining a chamber for storing a volume of compressed air and said filter means separating said chamber into a small volume section for prefiltered air and a relatively large volume section for filtered air.

2. The pneumatic tool as defined in claim 1 wherein said filter means is secured between said hollow handle peripheral wall and said cup-shaped closure means.

3. The pneumatic tool as defined in claim 2 wherein said cup-shaped closure means has an end portion which is opposed to said peripheral wall of said hollow handle; said cup-shaped closure means end portion includes a circumferential recess on an inner surface; and said recess receives said filter means so that an upper surface of said filter means is substantially flush with an upper surface of the cup-shaped closure means end portion.

4. The pneumatic tool as defined in claim 2 wherein said hollow handle includes a first part for connection with said cylinder and a second part having said open bottom aligned with the longitudinal axis of said handle; the cross sectional area of said second part perpendicular to the longitudinal direction is larger than that of said first part; and said filter means extends substantially perpendicular to the longitudinal direction of said hollow handle.

5. The pneumatic tool as defined in claim 2 wherein said cup-shaped closure means is secured to said hollow handle peripheral wall by a bolt.

6. The pneumatic tool as defined in claim 5 wherein said bolt includes a threaded shank inserted through the end portion of said closure means in a direction perpendicular to said filter means and is engaged with the peripheral wall of said hollow handle.

* * * * *